US008802004B2

(12) United States Patent
Naumann et al.

(10) Patent No.: US 8,802,004 B2
(45) Date of Patent: Aug. 12, 2014

(54) COMPONENT PRODUCED OR PROCESSED BY POWDER METALLURGY, AND PROCESS FOR PRODUCING IT

(75) Inventors: Dirk Naumann, Mississauga (CA); Thomas Weissgarber, Dresden (DE); Alexander Bohm, Hahnichen (DE)

(73) Assignees: Alantum Corporation, Seongnam (KR); Fraunhofer Gesellschaft zur Forderung der Angewandten Forschung E.V., Munich (DE)

( * ) Notice: Subject to any disclaimer, the term of this patent is extended or adjusted under 35 U.S.C. 154(b) by 1224 days.

(21) Appl. No.: 11/950,448

(22) Filed: Dec. 5, 2007

(65) Prior Publication Data

US 2008/0112833 A1 May 15, 2008

Related U.S. Application Data

(62) Division of application No. 10/540,459, filed as application No. PCT/EP03/14381 on Dec. 17, 2003, now abandoned.

(30) Foreign Application Priority Data

Jan. 8, 2003 (DE) ..... 103 01 175

(51) Int. Cl.
*B22F 3/11* (2006.01)
*B22F 7/00* (2006.01)

(52) U.S. Cl.
USPC ..... 419/6; 419/2; 419/32; 419/45; 419/46

(58) Field of Classification Search
USPC ..... 419/2, 6, 9, 32, 45, 5, 23, 26, 33, 47; 428/547, 550
See application file for complete search history.

(56) References Cited

U.S. PATENT DOCUMENTS

| | | | | |
|---|---|---|---|---|
| 2,267,918 | A * | 12/1941 | Hildabolt | 428/547 |
| 2,464,517 | A * | 3/1949 | Kurtz | 419/2 |
| 4,155,755 | A * | 5/1979 | Sara | 148/514 |
| 4,855,101 | A | 8/1989 | Mohs et al. | |
| 4,925,740 | A | 5/1990 | Norris et al. | |
| 5,634,189 | A | 5/1997 | Rossmann et al. | |
| 6,241,469 | B1 | 6/2001 | Beeck et al. | |
| 6,926,969 | B2 | 8/2005 | Bohm et al. | |
| 2001/0001640 | A1 | 5/2001 | Miller | |
| 2002/0104405 | A1 | 8/2002 | Haack et al. | |
| 2002/0172836 | A1 | 11/2002 | Takayama et al. | |

FOREIGN PATENT DOCUMENTS

| | | |
|---|---|---|
| CN | 1275457 | 12/2000 |
| DE | 32 10 770 | 9/1983 |
| DE | 39 02 032 | 7/1990 |
| DE | 43 38 457 | 5/1995 |
| DE | 101 50 948 | 11/2001 |
| EP | 0 657 950 | 6/1995 |
| JP | 02-256971 | 10/1990 |
| JP | 11-323406 | 11/1999 |
| WO | 01/70436 | 9/2001 |
| WO | 2004 0628 78 A3 | 10/2004 |

* cited by examiner

*Primary Examiner* — George Wyszomierski
*Assistant Examiner* — Ngoclan T Mai
(74) *Attorney, Agent, or Firm* — Lexyoume IP Meister, PLLC

(57) ABSTRACT

The invention relates to components which are produced or processed by powder metallurgy, and to processes for producing components of this type. The components produced by powder metallurgy are intended both to have porous regions and to provide fluid-tight properties, and it should also be possible to produce them at correspondingly low cost and suitably flexibly. For this purpose, a component of this type has at least one porous region, which is formed from an intermetallic phase or solid solutions. However, it may also have a corresponding surface coating. Moreover, in a component of this type there is at least one areal fluid-tight region which is formed from a meta or metal alloy of the corresponding intermetallic phase or solid solution.

7 Claims, No Drawings

COMPONENT PRODUCED OR PROCESSED BY POWDER METALLURGY, AND PROCESS FOR PRODUCING IT

This application is a divisional of U.S. application Ser. No. 10/540,459, filed on Jun. 22, 2005 now abandoned.

The invention relates to components which are produced by powder metallurgy or alternatively are processed by powder metallurgy and have at least one porous region, which is formed from an intermetallic phase or solid solutions, or have a surface coating of this type. In addition, the invention also relates to corresponding production processes. In this context, the term processing by powder metallurgy is to be understood as meaning a corresponding, retrospective processing of semifinished products, such as for example metal foam structures, by powder metallurgy.

The prior art has disclosed possible ways of producing sintered porous bodies which have been formed from intermetallic phases or solid solutions. A process of this type is described, for example, in DE 101 50 948. In this document, it is proposed for a powder with a sintering activity which at least forms intermetallic phases or solid solutions to be applied to the surface of a porous base body. Then, the formation of intermetallic phases or solid solutions is supposed to be initiated by means of a heat treatment. At the same time, the surface area can thereby be increased.

Although the bodies produced in this way have a relatively low inherent mass and also, if suitable intermetallic phases or solid solutions are selected, a high thermal stability, they cannot readily be used for some applications. This is true in particular with regard to use as a sealing element without additional assembly or connection to components which are impervious to the various fluids.

Therefore, it is an object of the invention to provide components which are produced by powder metallurgy and have both porous regions and fluid-tight properties and which can also be produced flexibly and at low cost.

The component according to the invention which is produced by powder metallurgy or is additionally processed in this way accordingly includes at least one porous region, which is formed from an intermetallic phase or solid solutions. However, a porous region of this type may also be provided with a corresponding surface coating which is formed from an intermetallic phase or solid solutions of this type.

Furthermore, there is at least one areal fluid-tight region which is formed from a metal, a metal alloy of the corresponding intermetallic phase or the corresponding solid solution.

The term fluid-tight is to be understood as meaning at least imperviousness to certain liquids, but also, under certain circumstances, gas-tightness and even imperviousness to low-molecular gases or gases with a low atomic number.

In an advantageous configuration, the fluid-tight region may form part of the outer shell of the component, which the correspondingly porous region may then adjoin in one direction.

However, it is also possible for a fluid-tight region of this type to be surrounded by the porous region. In this case, the fluid-tight region may form a type of core or alternatively a barrier within a component.

Nickel, aluminum, molybdenum tungsten, iron, titanium, cobalt, copper, silicon, cerium, tantalum, niobium, tin, zinc or bismuth can be used to form the intermetallic phases or solid solutions. It has proven particularly advantageous for at least the porous region to be made from nickel aluminide or to use a corresponding surface coating made from nickel aluminide, since this also makes it possible to achieve very good thermal stabilities.

However, the porous region may advantageously also be formed in such a way that a porosity changes in the direction of the areal, fluid-tight region. This may be effected in steps, i.e. in layers with different porosities within the individual layers, or a continuously graduated form.

The fluid-tight region should advantageously have a density which is over 96% of the corresponding theoretical density.

In one embodiment, however, the fluid-tight region may be formed from a pure metal or a metal alloy of the corresponding intermetallic phases or of a solid solution which is formed areally, for example in the form of a plate. For example, a porous region can be arranged on a nickel component which is, for example, of plate-like design and a porous region, which either consists of nickel aluminide or is surface-coated with nickel aluminide, can be joined by material-to-material bonding to it, as described in more detail below.

Furthermore, it is possible for at least one passage or an aperture to be formed within the fluid-tight region. A passage can be used, for example, for liquid or gaseous coolant to pass through. However, it is also possible to use a passage of this type and adjoining openings to generate a reduced pressure all the way into the porous region, so that a sucking or vacuum action can be achieved in that region.

However, apertures can also be used to secure a component according to the invention using mechanical means.

There are a number of alternative options for producing and/or coating components according to the invention.

For example, to produce components of this type, it may be expedient to use different starting powders. In this case, a starting powder which has a sintering activity and forms intermetallic phases or solid solutions should be used at least to form an areal, fluid-tight region. This makes it possible to make use of the effect whereby an increase in volume is observed during sintering, causing sufficiently dense sintering of the corresponding region, so that the required fluid-tightness can be achieved.

Starting powders with a mean grain size $d_{50}<50$ μm should be used in particular to form the porous region during sintering, it being possible, for example, to form the stepped or graduated porous regions which have already been mentioned above to be formed by means of a suitable selection of different grain size fractions.

However, it is also possible, in order to produce components according to the invention, to produce starting powders of the abovementioned grain size fraction in combination with a powder which has a sintering activity and is obtained by high-energy milling.

For example, a porous region may be formed exclusively from a starting powder of this type, while an adjoining region, which is likewise porous, may be formed by means of a mixture of this starting powder with a powder which has a sintering activity and is obtained by high-energy milling, and for a fluid-tight region then to be formed exclusively by means of a starting powder which has a sintering activity and is obtained by high-energy milling.

These different powders employed have different properties during the sintering. In this context, in particular the differing shrinkage is of importance.

For example, a powder preform which has been prepared for the powder metallurgy production of components according to the invention may have locally differing dimensions which take account of the different starting powders and their shrinkages which are observed during sintering, so that after sintering a component which is at least near net shape can be provided, requiring at most only slight remachining.

During production of a powder preform of this type, by way of example regions in which the powder preform contains starting powders with a higher sintering activity, such as for example powder mixtures obtained by high-energy milling, or have been formed in such regions exclusively from powders of this type with corresponding binders, are characterized by higher shrinkages, which have to be taken into account accordingly.

In another alternative, however, it is also possible for components according to the invention to be produced in such a way that a porous structure which is to form the porous region has already been areally coated with a powder which has a sintering activity and forms intermetallic phases or solid solutions. Then, the coated region can be formed in a fluid-tight manner on the corresponding surface of the components by means of a sintering operation.

In this case, by way of example, it is possible to use a porous starting structure such as a semifinished product, comprising a corresponding intermetallic phase or a solid solution.

However, it is also possible for a porous structure, likewise in the form of a semifinished product, such as a metal foam, preferably a nickel foam, to be surface-coated with a powder which forms intermetallic phases or solid solutions, as is known from DE 101 50 948, and for an areal layer then additionally to be formed on a surface from a powder which has a sintering activity and forms intermetallic phases or solid solutions and which then likewise forms the fluid-tight region during sintering. For example, the porous structure, i.e. the porous region of a component according to the invention, can be correspondingly modified and the fluid-tight region formed in a sintering operation.

A further alternative production option consists in a metallic element, which is areal and fluid-tight at least in regions and is to form the fluid-tight region, to be joined to a porous structure, which then forms the porous region, by material-to-material bonding. This can be achieved by means of a sintering operation in which the metallic areal element is coated beforehand with a layer of a powder which contains at least one element of the intermetallic phase or of the corresponding solid solution and forms a material-to-material bond with this powder during sintering. The metallic areal element may likewise be formed from an element of the corresponding intermetallic phase or solid solution or from an alloy of this element.

The invention is to be described below by way of example.

EXAMPLE 1

A starting powder mixture which contains nickel and aluminum was used to produce an example of a component according to the invention. The grain size fraction was in the range between 5 and 30 μm.

A nickel to aluminum atomic ratio of 50/50 atomic % was maintained for the mixture composition. The nickel and aluminum starting powders were mixed with one another for a period of 0.5 h. This mixture 51 was then divided into two partial quantities. One of these partial quantities was subjected to high-energy milling in a Fritsch P5 planetary ball mill at a rotational speed of 250 min/h for a period of 1 h. This resulted in a part mixture M2. In turn, a third part mixture M3 was produced from the mixture 51 and the mixture M2, containing these two mixtures in equal parts.

Components were compacted from these mixtures in advance by die-pressing in the following order: mixture M1, mixture M2 and mixture M3.

Then, a reaction sintering operation was carried out in vacuo at a temperature in the region of 1150° C., and a component according to the invention which has three different porous regions was produced. That part of the component which was formed from powder mixture M3 forms the fluid-tight region, whereas the regions formed from mixtures M1 and M2 had a significantly higher porosity.

It was possible to use the powder mixtures with conventional binders which are known per se and are removed during sintering. The grain sizes of the different starting powders M1 to M3 were kept virtually constant, and accordingly in this example there is no grain size change in the high-energy milling process, only the sintering activity of the powder having been changed.

EXAMPLE 2

A nickel foam structure is surface-coated with a pure aluminum powder or a nickel-aluminum powder obtained by high-energy milling. A nickel/aluminum atomic ratio in the range between 75 to 50 atomic % of nickel to 25 to 50 atomic % of aluminum was maintained. The coating with a powder of this type was carried out in such a way that an open porosity of the nickel foam was retained. The nickel foam body prepared in this way was then coated on one side with a powder M3 as described in Example 1, after which sintering was again carried out at a temperature of approx. 1150° C. The corresponding intermetallic phases were formed on the surface of the nickel foam and a fluid-type region comprising nickel aluminide was formed where the powder M3 was additionally applied.

The embodiments of the invention in which an exclusive property or privilege is claimed are defined as follows:

1. A process for producing a component including a porous region and an areal fluid-tight region by powder metallurgy, the process comprising:

providing a starting powder which has a sintering activity and which forms at least one of (a) intermetallic phases and (b) solid solutions;

sintering a first portion of the starting powder to form the porous region, which is formed from at least one of (a) an intermetallic phase and (b) solid solutions; and sintering a second portion of the starting powder to form the areal fluid-tight region, which is formed from at least one of (a) a metal, (b) a metal alloy, and (c) a corresponding intermetallic phase or solid solution;

wherein the first portion of the starting powder has a grain size $d_{50}$<50 μm and wherein the second portion of the starting powder has sintering activity obtained by high-energy milling.

2. The process of claim 1, further comprising producing a powder preform from the first and second portions of the starting powder, wherein the preform has dimensions based on respective shrinkages of the first and second portions of the starting powder that occur during sintering.

3. A process for producing a component including a porous region and an areal fluid-tight region by powder metallurgy, the process comprising:

providing a starting powder which has a sintering activity and which forms at least one of (a) intermetallic phases and (b) solid solutions;

sintering a first portion of the starting powder to form the porous region, which is formed from at least one of (a) an intermetallic phase and (b) solid solutions;

sintering a second portion of the starting powder to form the areal fluid-tight region, which is formed from at least one of (a) a metal, (b) a metal alloy, and (c) a corresponding intermetallic phase or solid solution; and providing the areal fluid-tight-region with a surface coating formed from at least one of (a) the intermetallic phase and (b) the solid solutions.

4. The process of claim 3 wherein the corresponding intermetallic phase or the solid solutions are selected from at least one of the group consisting of nickel, aluminum, molybdenum, tungsten, iron, titanium, cobalt, copper, silicon, cerium, tantalum, niobium, tin, zinc and bismuth.

5. The process of claim 3, wherein the porous region adjoins the areal fluid-tight region in at least one direction.

6. The process of claim 3, wherein the areal fluid-tight region is surrounded by the porous-region.

7. The process of claim 3, wherein the porous region has a porosity that changes in the direction of the areal fluid-tight region.

* * * * *